United States Patent [19]

Hess et al.

[11] 4,423,566

[45] Jan. 3, 1984

[54] DRIVE ARRANGEMENT FOR A WINDOW LIFTING MECHANISM

[75] Inventors: Hans-Peter Hess, Coburg; Günter Mühling, Grub a. Forst, both of Fed. Rep. of Germany

[73] Assignee: Metallwerk Max Brose GmbH & Co., Coburg, Fed. Rep. of Germany

[21] Appl. No.: 274,664

[22] Filed: Jun. 17, 1981

[30] Foreign Application Priority Data

Jun. 24, 1980 [DE] Fed. Rep. of Germany ..... 3023641

[51] Int. Cl.[3] ..... E05F 11/48

[52] U.S. Cl. ..... 49/352

[58] Field of Search ..... 49/352, 348, 349, 350, 49/351, 360

[56] References Cited

U.S. PATENT DOCUMENTS 3,427,748 2/1969 Marr ..... 49/352
4,191,060 3/1980 Sessa ..... 49/352 X
4,235,046 11/1980 Hess et al. ..... 49/352
4,237,657 12/1980 Kazewych ..... 49/352

*Primary Examiner*—Philip C. Kannan
*Attorney, Agent, or Firm*—Toren, McGeady and Stanger

[57] ABSTRACT

A drive mechanism for the window of a motor vehicle having a driven base member with the window affixed thereto and guided for movement along a longitudinal guide rail is activated by a driving member which is connected with the base member to drive the base member along the guide rail. A guide flange provided on the guide rail is engaged with slide elements formed on the base member which are arranged to rest against the sides of the guide rail and at least one of the slide elements is formed with a flexible construction. The slide elements include a pair of lateral slide elements arranged spaced apart in the longitudinal direction of the guide rail which rest against one side of the guide flange and a central slide element arranged between the lateral slide elements which rests against the other side of the guide flange.

20 Claims, 7 Drawing Figures

FIG. 2
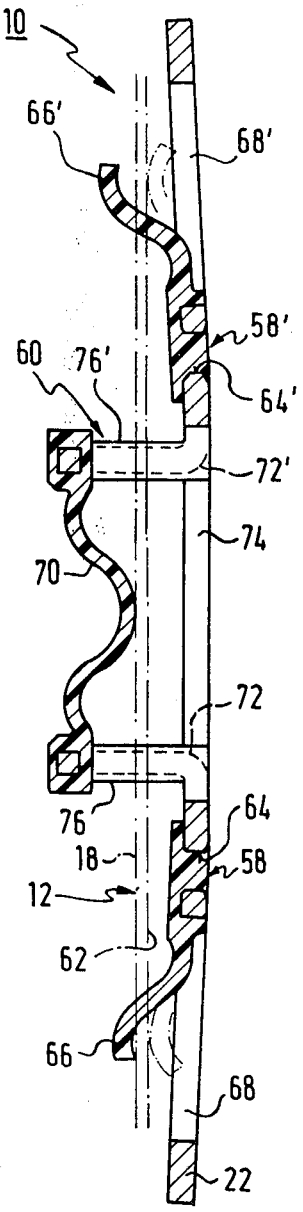
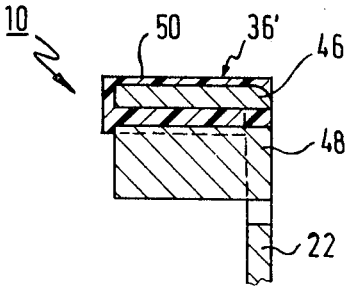
FIG. 4
FIG. 3
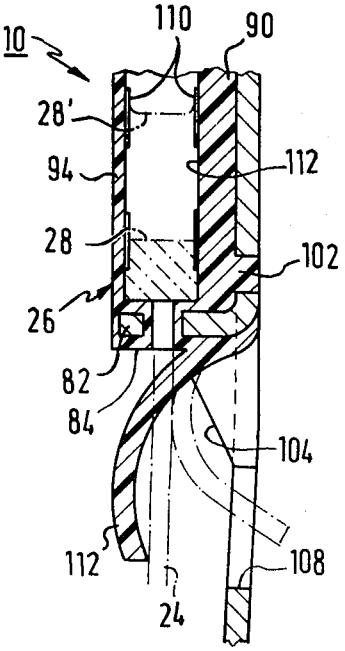

DRIVE ARRANGEMENT FOR A WINDOW LIFTING MECHANISM

The present invention relates generally to a drive arrangement for a window lifting mechanism, particularly a window lifting mechanism for a motor vehicle. The drive arrangement is adapted to be moved by a drive member which may comprise a driving rope, a coiled cable or a linkage arm which moves a driven base member along a guide rail. The driven base member has a windowpane affixed thereto and slide elements provided on the driven base member are constructed to rest against both sides of a guide flange of the guide rail. The guide flange is arranged to extend essentially parallel to the surface of the windowpane.

A drive arrangement of the type to which the present invention relates is known from German Pat. No. 15 55 632 wherein a guide flange is guided in slots of slide elements which are rigidly installed in the drive arrangement. Such a slot must not be dimensioned with too great a width because otherwise rattling noises are likely to occur. Additionally, the slot must not be overly narrow in order to avoid the danger of jamming of the mechanism. However, even if such a slot is exactly adjusted and dimensioned, mechanical stresses may still occur and as a result difficulties may arise in the functioning of the window lifting mechanism. Furthermore, increased wear will occur when the space which is allotted between the window lifting mechanism and the windowpane, particularly the space between the guide rail and the lateral windowpane guide means, is not adhered to with sufficient exactness during installation of the window lifting mechanism. This would arise, for example, when the distance between the surface of the windowpane and the inner door lining deviates from a desired value.

The present invention is directed toward provision of a drive arrangement of the type described which permits greater latitude in the tolerances required for the structural parts of the window lifting mechanism and in the installation tolerances. Furthermore, the invention provides a mechanism which will operate with a lower noise level, and which will exhibit greater ease in the operation of the window lifting mechanism.

SUMMARY OF THE INVENTION

Briefly, the present invention may be described as a drive arrangement for a window lifting mechanism, particularly for the window lifting mechanism of a motor vehicle, comprising a driven base member having the window affixed thereto, a longitudinal guide rail supportably engaging the base member to guide the movement thereof, a driving member connected with the base member to drive the base member along the guide rail, a guide flange provided on the guide rail having sides which extend generally parallel to the plane of the window, and slide elements formed on the base member arranged to rest against the sides of the guide flange. In accordance with the present invention, at least one of the slide elements is formed with a flexible construction. Furthermore, the slide elements are arranged to include a pair of lateral slide elements which are spaced apart in the longitudinal direction of the guide rail and which rest against one side of the guide flange and a central slide element which is arranged between the two lateral slide elements and which rests against the other side of the guide flange.

In accordance with the present invention, the driven base member which is rigidly connected with the windowpane may undergo some lateral deviation in its movement within a given distance from the guide rail as a result of the motion clearance which is produced by the flexible slide elements in directions perpendicular to the surface of the windowpane. The invention is especially advantageous for use with heavily curved windowpanes because here again the tolerances need not be adhered to exactly. Thus, difficulties which might otherwise arise due to requirements for adhering to narrow tolerances may be alleviated. For example, the slots of the drive arrangement may extend in an inclined manner in accordance with the curvature of the guide rail. The guide rail must be manufactured with accuracy and must not only be installed in an adjusted manner with respect to its horizontal distance relative to the surface of the windowpane but also relative to its height.

In the preferred embodiment of the invention, the drive arrangement is provided with two lateral slide elements which are arranged spaced apart in the longitudinal direction of the guide rail and which rest against one side of the guide flange of the guide rail. Also, the central slide element which is arranged between the two lateral slide elements rests against the opposite side of the guide flange. As a result, the guide flange is securely held by a relatively simple structural arrangement.

The lateral slide elements may be constructed as tongue springs which are attached at one end at the driven base member and which have free ends which rest against the guide flange of the guide rail. Also, the central slide element may be structured as a tongue spring which is attached at both its ends to the driven base member and which rests in the region of its flexible center portion against the guide flange of the guide rail.

In applications in which the drive arrangement may, during operation, rest without clearance for at least the major length of the guide rail, it is preferred that on the driven base member there be provided a pair of guide bulges or protuberances which are arranged spaced apart in the longitudinal direction of the guide rail and which rest with an approximately punctiform contact against the guide surface of the guide rail which extends approximately parallel to the surface of the window and which faces the driven base member. Additionally, on the base member, a flexible slide element is arranged between the guide bulges which rests under initial tension at a guide surface of the guide rail facing away from the base member. There may thus be obtained a low-friction dual-point support which may be utilized without modification for guide rails having different curvatures. The flexible slide element permits a temporary increase in the distance between the driven base member and the guide rail.

In the case of a guide rail having a U-sectional configuration with a bent flange at one of its sidewalls (ZU-section), it is preferred that the lateral flange form the guide flange and that, if appropriate, the guide bulges are arranged to rest against the inner surface of the base wall which connects the sidewalls of the U-shaped configuration. This arrangement permits some swiveling motion about an axis parallel to the longitudinal direction of the guide rail in addition to providing the capability for lateral movement through a distance between the driven base member and the guide rail.

A special advantage of a guide rail formed as a ZU-section arises in that the side slide elements can be arranged at the base member which engage around the other walls of the U-shaped configuration on both sides and which thus prevent tilting of the driven base member about a tilting axis perpendicular to the surface of the window. It is suggested that the guide bulges be constructed at one of the side slide elements.

When a driving rope or cable which engages the driven base member is utilized, it is preferred if the base member is provided with at least one spring element for stressing this drive cable. The spring element may be constructed as a tongue spring which is attached at one end on the driven base member and which has a free end resting against the driving cable.

For attachment of rope nipples which connect the ends of the driving cable with the driven base member, it is preferred to provide the driven base member with a receiving chamber for the rope nipples with an inlet opening in one of the sidewalls of such a chamber being parallel to the axis of the rope or cable and with a slot in one of the front walls of the chamber which is perpendicular to the rope axis. This slot opens into an inlet opening and may be adjusted with regard to the thickness of the driving rope or cable.

The rope nipple may be reliably prevented from becoming disengaged when the rope is loose by providing projections in the region of the inlet opening at the lateral walls of the receiving chamber.

The driven base member formed in accordance with the invention is economical to manufacture but nevertheless mechanically sturdy since it may be constructed as a plate member preferably of metal. The slide elements may be formed of plastic and a plastic spray may be applied to the spring elements and the nipple receiving chamber parts.

A particular plastic which is preferred is a polyacetal copolymer.

The mechanical stability and strength of the device is increased when the slide elements, the spring elements, and the nipple receiving chamber parts are installed at brackets which are bent out of the plate material of the driven base member and when the plate material is provided in the region of the sprayed-on plastic parts with fastening holes which may be filled with plastic. When the fastening holes of the sprayed-on parts which are arranged on only one side of the plate forming the base member are enlarged approximately conically toward each other, then cohesion between the parts and the plate member may be increased.

At a curved windowpane and a correspondingly curved guide rail, it is suggested that the plate be curved in the same direction as the windowpane. This measure will reduce the structural height of the parts which are to be installed on the plate.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF THE DRAWINGS

In the drawings:

FIG. 2 is a sectional view taken along the line II—II in FIG. 1;

FIG. 3 is a sectional view taken along the line III—III in FIG. 1;

FIG. 4 is a sectional view taken along the line IV—IV in FIG. 1;

DETAILED DESCRIPTION OF THE PREFERRED EMBODIMENT

Figure 1:
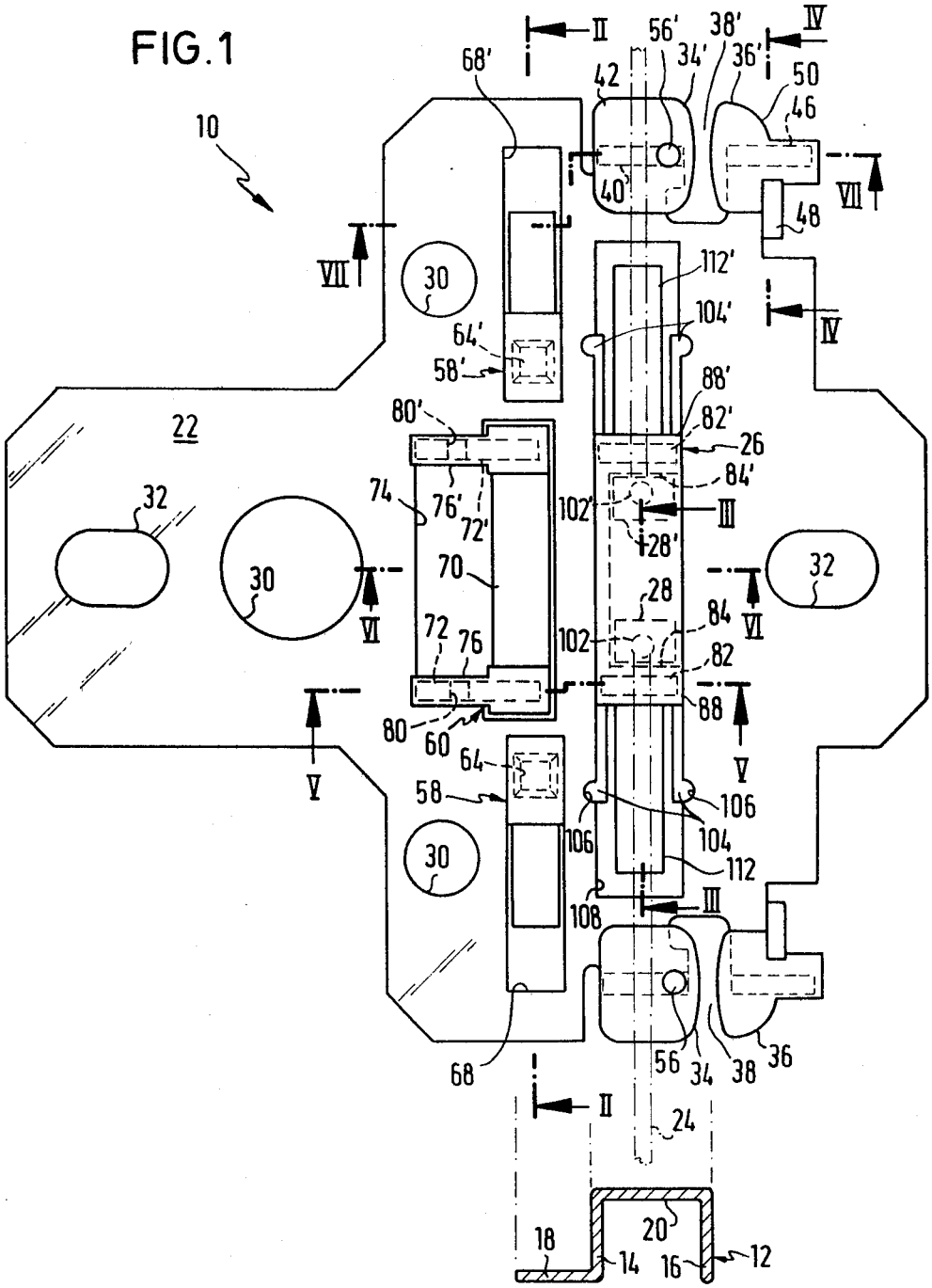
FIG. 1 is a plan view of a window drive arrangement in accordance with the present invention.

Referring now to the drawings, wherein similar parts are identified with like reference numerals throughout the various figures thereof, there is shown in FIG. 1 an overall assembly of a drive mechanism 10 structured in accordance with the present invention adapted for operation as a window lifting mechanism.

The mechanism of FIG. 1 is adapted to replace a drive arrangement such as the drive arrangement 14 of a coiled cable window lifting mechanism of the type shown in FIG. 1 of German Patent No. 15 55 632; a rope window lifting mechanism of the type shown in FIG. 10 of this patent; or a window lifting mecahnism of the type shown in FIG. 11 of this patent.

The drive mechanism 10 shown in FIG. 1 is guided for movement along a guide rail 12 which, in FIG. 1, is shown to extend from the top to the bottom of the drawing. The guide rail 12 is formed with a cross section at the bottom of FIG. 1, but it is understood that this sectional view has been turned 90° relative to the plane of the drawing and it should be understood that the sectional view of the guide rail 12 shown at the bottom of FIG. 1 is essentially a view taken along a plane extending perpendicularly to the plane of the drawing. In FIGS. 1, 2, 5, 6, and 7, the guide rail 12 is shown schematically in dash-dot line form.

As indicated particularly in FIG. 1, the guide rail 12 is essentially formed with a ZU-sectional configuration wherein the U-shaped portion includes a pair of sidewalls 14 and 16 of which the wall 14, shown at the left in FIG. 1, is provided with a flange 18 which extends perpendicularly relative thereto from the front end thereof. A base wall 20 connects the two sidewalls 14 and 16 of the U-shaped configuration.

The drive mechanism 10 is formed with a driven base member which consists of a plate 22 formed from a sheet metal member approximately 2 mm in thickness. The plate 22 is formed with slide elements, to be described more fully hereinafter, which engage on the guide rail 12 and thus support the plate 22 on the guide rail 12 for guided movement therealong.

In the embodiment depicted, the drive mechanism 10 is actuated or driven along the rail 12 by a driving rope or cable 24 which is shown in the drawing in dash-dot line form.

The plate 22 is configured to define a receiving chamber 26 within which a pair of rope nipples 28 engage to attach the rope ends within the chamber 26. With the rope ends engaged within the chamber 26, the rope 24 operates to drive the drive mechanism 10 and thus to move a windowpane (not shown) which is affixed or attached either directly or indirectly with the plate member 22 by means of a holding rail (not shown). Fastening holes 30 are formed on or preferably punched out of the plate 22 in order to enable attachment of the window or the window holding rail with the plate 22.

Two holes 32 of the fastening holes formed on the plate 22 are formed with an oblong configuration in order to permit adjustable attachment of the windowpane.

The sidewall 16 of the guide rail 12 shown to the right in FIGS. 1, 5, 6, and 7 is arranged to extend through a pair of slots 38 and 38' located respectively at the upper and lower ends of the plate 22 as seen in FIG. 1. The slot 38 is defined between a slide element 34 on the inner side of the device and a slide element 36 on the outer side, with the slot 38' being defined between a slide element 34' on the inner side and a slide element 36' on the outer side. These slide elements correspond in their construction with each other and thus the slide elements 34 and 34' are generally similar and the slide elements 36 and 36' are generally similar.

Figure 7:
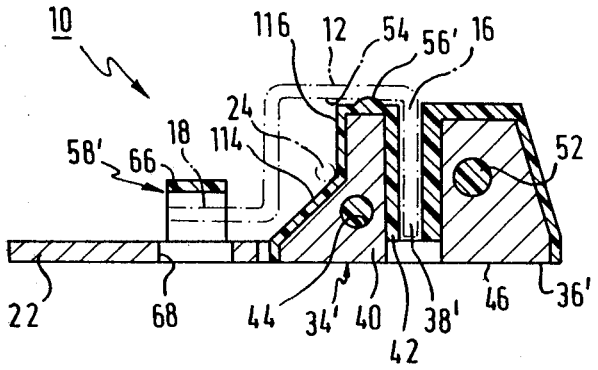
FIG. 7 is a sectional view taken along the line VII—VII in FIG. 1.
Figure 6:
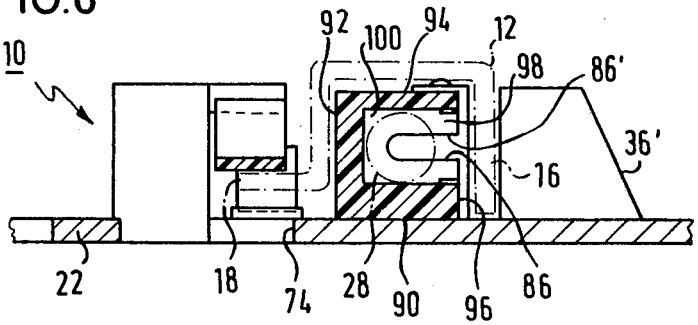
FIG. 6 is a sectional view taken along the line VI—VI in FIG. 1.
Figure 5:
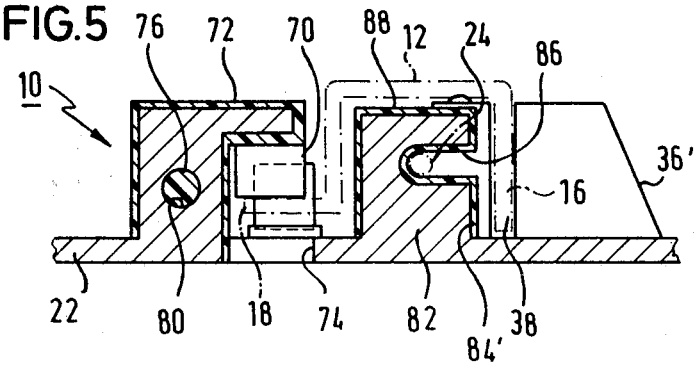
FIG. 5 is a sectional view taken along the line V—V in FIG. 1.

As will be evident from FIGS. 1 and 7, the slide element 34' for the inner side consists of a sheet metal lug 40 which is upwardly bent perpendicularly from the plate 22. A plastic covering 42 of polyacetal copolymer is sprayed on the lug.

As is best seen in FIG. 7, the sheet metal lug 40 is provided with a bore 44 which is filled with plastic material serving to affix the plastic covering 42.

The slide element 36' for the outer side of the device consists of a first sheet metal lug 46 which, like the sheet metal lug 40, is formed with a bent edge which is perpendicular to the longitudinal direction of the guide rail 12. However, in order to increase mechanically stability, a second sheet metal lug 48 is upwardly bent from the plate 22 with a bent edge which is parallel with the longitudinal direction of the guide rail 12, as also seen in FIG. 4.

Both sheet metal lugs 46 and 48 are surrounded at least partially with a sprayed-on plastic covering 50. In the sheet metal lug 46 there is also formed a bore 52 punched out therefrom for affixation of the plastic covering 50.

As will be evident from FIGS. 1 and 7, the slide elements 34' and 36' for the inner and outer sides are located opposite each other in such a way that the slot 38' is formed to enable operation thereof as a guide means for the sidewall 16 of the guide rail 12. In order to prevent jamming of the mechanism and in order to obtain, by means of limited contact surfaces, frictional values which are as small as possible, the lateral surfaces of the side slide elements 34' and 36' which define the slot 38' and which face one another are each formed with a curvature facing toward the other element, the axis of curvature being perpendicular to the plane of the plate 22, as best seen from FIG. 1.

The base wall 20 of the U-shaped portion of the guide rail 12 lies with its inner surface 54 facing the plate 22 upon a rounded off guide bulge or protuberance 56' which, as will be evident from FIGS. 1 and 7, is formed from the upper side of the slide element 34'. Accordingly, a guide bulge or protuberance 56 is also formed on the slide element 34 with the bulges 56 and 56' forming, due to their relatively small contact surface, a low friction, dual-point contact which is not affected by any possible curvature of the guide rail 12.

The flange 18 of the guide rail 12 is flexibly held between three slide elements identified by reference numerals 58, 58', and 60. The slide elements 58 and 58' are lateral slide elements which are laterally spaced from each other in the longitudinal direction of the guide rail 12, as will be evident from FIGS. 1 and 2. The slide element 60 is a central slide element located between the slide elements 58 and 58', as will also be evident from FIGS. 1 and 2. The lateral slide elements 58 and 58' rest against a side 62 of the flange 18 which faces the plate 22. In FIG. 2, the outlines of the lateral slide elements 58 and 58' are shown in dotted line form in the position which they occupy when they are bent in a direction toward the plate 22 due to engagement against the flange 18 when the rail 12 is inserted in the driving mechanism.

The lateral slide elements 58 and 58' are constructed as tongue springs which are arranged to extend in the longitudinal direction of the guide rail 12 and which are attached with adjacent ends to the plate 22. For this purpose, one fastening hole 64 or 64' is punched from the plate 22 with this hole being slightly conically enlarged on the side of the plate 22 facing away from the guide rail 12. This configuration improves support of the lateral elements 58, 58' which may be sprayed on the other side of the plate. The free upwardly curved ends 66 and 66' of the lateral slide elements 58 and 58' shown extending to the left in FIG. 2 will be bent by the flange 18 and biased toward a punched-out recess 68 or 68' formed in the plate 22.

The central slide element 60 consists of a wavy tongue spring 70 which, in its central region, is curved toward the plate 22 and which in this region rests with low frictional contact against the flange 18. The tongue spring 70 is attached at both its ends with an approximately L-shaped lug 72 and 72', with each of the lugs 72, 72' being bent outwardly of the plate 22 with a bent edge which extends perpendicularly to the longitudinal direction of the guide rail 12. An opening 74 is thereby formed in the plate 22. In a manner similar to that described in connection with the side slide elements, the lugs 72 and 72' are also enclosed by a sprayed-on plastic covering 76, 76'. The plastic coverings 76, 76' are formed integrally with the tongue spring 70 which connects the two coverings. Bores 80, 80' are punched from the lugs 72 and 72' and are filled out with plastic to improve the cohesion of the plastic covering 76, 76' on the lugs 72, 72'.

The drive mechanism 10 is supported at the guide rail 12 in such a manner that even large bending moments applied about an axis perpendicualar to the plate 22 may be directly diverted by means of the substantial mechanical strength of the side slide elements 34, 34' and 36, 36' to the guide rail 12. Low frictional movement of the guide rail 12 between the side slide elements is ensured and in addition, during normal operating conditions, the guide rail 12 will rest with low frictional contact on the guide bulges 56 and 56'. However, enlargement of the distance between the drive mechanism 10 and the guide rail 12 is possible against the biasing force of the spring tongue 70. If the width of the slots 38, 38' is selected appropriately, there may also occur some rotary motion of the drive mechanism 10 with respect to the guide rail 12 about a swivel axis parallel to the longitudinal direction of the guide rail 12. In any case, rattling of the drive mechanism 10 on the guide rail 12 will be prevented because the flange 18 will be held on both sides by prestressed springs comprised of the lateral slide elements 58 and 58' and the central slide element 60.

Manufacturing of the drive mechanism described herein may be accomplished in an especially economical manner because only a few working steps are required. After the sheet metal lugs are punched out and bent, plastic parts may be sprayed on which may be accomplished in a single work step. The drive mechanism described is quite sturdy and there is very little friction between the drive mechanism 10 and the guide rail 12 because the guide rail 12 rests only against the plastic parts with only point or line contact.

The structural parts necessary for connection of the driving rope 24 may also be manufactured in a very economical manner simultaneously with the slide elements. Here again sheet metal lugs are bent out and subsequently spray covered. For example, in the formation of the receiving chamber, a sheet metal lug 82 as well as a sheet metal lug 82' may be formed on the interior of the front walls 84 and 84' which are perpendicular relative to the longitudinal direction of the guide rail 12 and consequently relative to the direction of action of the rope 24. The sheet metal lugs 82 and 82' are each provided with a sprayed-on plastic covering 88 and 88'. The lateral walls 90, 92, 94, and 96 of the receiving chamber 26 extend between and are a part of the two coverings 88 and 88'. In the lateral wall 96 shown at the right in FIG. 6, an inlet opening 98 is provided which enables access to the approximately cubical chamber interior 100. The rope nipples 28, 28' which are attached to the rope ends are inserted through the inlet opening 98 into the chamber interior. The rope 24 moves along a slot 86 or 86' until it reaches the slot end in the region of the center of the respective front wall 84 or 84'. In order to further improve the anchorage of the receiving chamber 26, two fastening holes 102 and 102' are punched out of the plate 22 and are filled with plastic material thereby extending into the bottom lateral wall 90 of the receiving chamber 26. The two sidewalls 104, 104' which support the front wall 84, 84' also serve as reinforcement. As shown in FIG. 3, the sidewalls 104, 104' are sloped. They each end in a semicircular convexity 106 of a recess 108 which is punched out of the plate 22.

The receiving chamber 26 thus reinforced may therefore withstand greater tension and transfer loads without problems to the plate 22.

In order to prevent a rope nipple 28 from falling out of the receiving chamber 26 when the rope 24 is loose, for example during assembly of the window lifting mechanism, projections 110 are constructed in the region of the inlet opening 98 at the upper and lower lateral walls 90 and 94. The inside distance of these projections is somewhat smaller than the diameter of the rope nipple 28. In order to still enable insertion of the rope nipple 28, it is necessary either to overcome the resistance shown by the projections 110 or to insert the rope nipple 28 in the region 112 (see FIG. 3) which is free of projections 110.

At the front walls 84, 84', between the sidewalls 104, 104', tongue springs 112 are formed integrally as shown in FIG. 3 and are bent downwardly by the stessed rope 24 into positions indicated in dotted line form. The springs 112 exert a counteracting force against the driving rope 24 which increases with deflection of the springs. Accordingly, the driving rope 24 will be deflected by the tongue spring 112 from its stretched position. Shocks which may occur during movement of the drive arrangement 10 or in the driving rope 24 will be at least partially elastically absorbed by the tongue spring 112 and will therefore only by transferred to a reduced extent to the respective structural parts of the unit. As a result, less noise will be developed and less wear of the window lifting mechanism will occur. The tongue springs 112 can also compensate in part for elongation of the rope after extensive operation of the device and they may thus automatically cause the rope to be stretched and to be maintained in a taut position.

The slide elements 34, 34' for the inner sides of the device serve also to guide the driving rope 24. As will be seen from FIG. 7, at the side of the slide element 34 which is remote from the slot 38, an inclined guide surface 114 is provided which adjoins at the top in FIG. 7, a vertical guide surface 116. The driving rope 24 rests at this junction area of the two surfaces and the rope is in any case prevented from moving to the right in FIG. 7 which, as may be seen from FIG. 6, could result in the rope nipple 28 moving out of the receiving chamber 26.

While a specific embodiment of the invention has been shown and described in detail to illustrate the application of the invention principles, it will be understood that the invention may be embodied otherwise without departing from such principles.

What is claimed is:

1. A drive mechanism for a window, particularly the window of a motor vehicle, comprising a driven base member having means for enabling a window to be affixed thereto, a longitudinal guide rail supportably engaging said base member to guide movement thereof, a driving member connected with said base member to drive said base member along said guide rail, a guide flange provided on said guide rail extending generally in the direction of movement of said base member, and slide elements formed on said base member arranged to rest against said guide flange, with at least one of said slide elements being formed with a resilient structure to hold said base member in resilient engagement with said guide flange.

2. A drive mechanism for a window, particularly the window of a motor vehicle, comprising a driven base member having means for enabling a window to be affixed thereto, a longitudinal guide rail supportably engaging said base member to guide movement thereof, a driving member connected with said base member to drive said base member along said guide rail, a guide flange provided on said guide rail extending generally in the direction of movement of said base member, and slide elements formed on said base member arranged to rest against said guide flange, with at least one of said slide elements being formed with a resilient structure to hold said base member in resilient engagement with said guide flange, said slide elements comprising a pair of lateral slide elements arranged spaced apart in the longitudinal direction of said guide rail and located to rest against one side of said guide flange and a central slide element arranged between said lateral slide elements and resting against the other side of said guide flange.

3. A mechanism according to claim 2 wherein said lateral slide elements are constructed as tongue springs which are attached at at least one end thereof with said base member.

4. A mechanism according to claim 2 further including spring means attached on said driven base member for applying a tensioning spring force against said driving member.

5. A mechanism according to claim 2 wherein said driven base member is formed as a metallic plate member.

6. A mechanism according to claim 2 wherein said central slide element is constructed as a tongue spring having two ends attached at said driven base member with the center portion thereof resting against said guide flange.

7. A mechanism according to claim 6 further comprising a pair of guide protuberances arranged spaced apart in the longitudinal direction of said guide rail and formed on said driven base member to establish point contact against a side of said guide rail which faces toward said driven base member, said guide protuberances being located on opposite sides of said central slide element in the longitudinal direction of said guide rail.

8. A mechanism according to claim 2 or 7 wherein said guide rail is formed with a U-shaped cross section including a pair of generally parallel sidewalls and a base wall interconnecting said sidewalls and wherein said guide flange is formed to extend perpendicularly from one of said sidewalls from the free end thereof.

9. A mechanism according to claim 7 wherein said guide rail is formed with a U-shaped cross-sectional configuration including a pair of generally parallel sidewalls and a base wall interconnecting said sidewalls and wherein said guide protuberances rest against the surface of said base wall facing toward said generally parallel sidewalls.

10. A mechanism according to claim 2 wherein said driving member comprises a generally elongate cable having a pair of ends attached with said base member, each of said ends of said cable having nipples thereat for maintaining said cable in driving engagement with said base member, said base member being formed with a receiving chamber within which said nipples are recieved and maintained in driving engagement, said receiving chamber being defined by lateral walls which extend parallel with the longitudinal direction of said cable and with end walls which extend generally perpendicularly to the longitudinal direction of said cable, said end walls being formed with a slot within which said cable may be inserted to hold said nipples engaged in driving position.

11. A mechanism according to claim 10 wherein in the region of said slots said receiving chamber is formed with projections which are constructed to prevent said rope nipples from becoming dislodged when said driving cable is in a loosened condition.

12. A mechanism according to claim 2 wherein said guide rail is formed with a U-shaped cross-sectional configuration having said guide flange extending from one side thereof and wherein said base member includes means defining guide slots within which said U-shaped configuration is guidingly engaged.

13. A mechanism according to claim 12 wherein said means defining said guide slots are configured with notch means adjacent said guide slots for guiding said driving member therein.

14. A drive mechanism for a window, particularly the window of a motor vehicle, comprising a driven base member having means for enabling a window to be affixed thereto, a longitudinal guide rail supportably engaging said base member to guide movement thereof, a driving member connected with said base member to drive said base member along said guide rail, a guide flange provided on said guide rail extending generally in the direction of movement of said base member, and slide elements formed on said base member arranged to rest against said guide flange, with at least one of said slide elements being formed with resilient structure to hold said base member in resilient engagement with said guide flange, said mechanism further comprising spring means for applying a spring force against said driving member to hold said driving member in a taut condition and means defining a receiving chamber within which ends of said driving member may be engaged to hold said driving member in driving engagement with said base member, said spring means and said receiving chamber means being formed on said base member, each of said slide elements, said spring means and said receiving chamber means being formed of plastic material.

15. A mechanism according to claim 14 wherein said plastic material is sprayed on said base member.

16. A mechanism according to claim 14 wherein said slide elements, said spring means and said means defining said receiving chamber are formed of polyacetal copolymer 17. A mechanism according to claim 14 wherein said driven base member is formed as a metallic plate member and wherein said slide elements, said spring means and said means defining said receiving chamber are installed upon lugs which are bent out of said metallic plate member.

18. A mechanism according to claim 17 wherein said metallic plate member is formed with fastening holes and wherein the plastic material forming said slide elements is formed integrally with material extending into said fastening holes to fill said fastening holes and thereby firmly mount said slide elements on said metallic plate member.

19. A mechanism according to claim 17 wherein said fastening holes are formed with a conical configuration.

20. A drive mechanism for a window, particularly the window of a motor vehicle, comprising a driven base member having means for enabling a window to be affixed thereto, a longitudinal guide rail supportably engaging said base member to guide movement thereof, a driving member connected with said base member to drive said base member along said guide rail, a guide flange provided on said guide rail extending generally in the direction of movement of said base member, and slide elements formed on said base member arranged to rest against said guide flange, with at least one of said slide elements being formed with a resilient structure to hold said base member in resilient engagement with said guide flange, said driving member comprising a generally elongate cable having a pair of ends attached with said base member, each of said ends of said cable having nipples thereat for maintaining said cable in driving engagement with said base member, said base member being formed with a receiving chamber within which said nipples are received and maintained in driving engagement, said receiving chamber being defined by lateral walls which extend parallel with the longitudinal direction of said cable and with end walls which extend generally perpendicularly to the longitudinal direction of said cable, said end walls being formed with a slot within which said cable may be inserted to hold said nipples engaged in driving position.

* * * * *